US005704850A

United States Patent [19]

Shieh

[11] Patent Number: 5,704,850

[45] Date of Patent: Jan. 6, 1998

[54] STRUCTURE OF GOLF CLUB HEAD

[76] Inventor: Tien Wu Shieh, No. 119, Peiping Road, Feng Shan City, Kaohsiung, Taiwan

[21] Appl. No.: 756,874

[22] Filed: Sep. 12, 1996

[51] Int. Cl.[6] ..... A63B 53/04

[52] U.S. Cl. ..... 473/324; 473/345

[58] Field of Search ..... 473/324, 345, 473/346, 305

[56] References Cited

U.S. PATENT DOCUMENTS

| | | | |
|---|---|---|---|
| 4,021,047 | 5/1977 | Mader | 473/345 |
| 5,536,011 | 7/1996 | Gutowski | 473/345 |
| 5,611,742 | 3/1997 | Kobayashi | 473/345 |

*Primary Examiner*—William M. Pierce

*Attorney, Agent, or Firm*—Pro-Techtor International

[57] ABSTRACT

A golf club head including a bowl-like casing integrally made from metal by forging, having a front side forming a face panel, and a smoothly curved coupling receptacle disposed at one end of the face panel at the back side; a top cover plate welded to the bowl-like casing at the top in a flush manner, the top cover plate having a plurality of rear projections raised from the rear side and supported on the top edge of the bowl-like casing at the back and then fixedly secured thereto by welding, and a plurality of smoothly and downwardly curved front projecting blocks respectively abutted against the back side of the face panel and then fixedly secured thereto by welding; and, a neck tube inserted through the side notch of the top cover plate into the coupling receptacle of the bowl-like casing and then fixedly welded thereto at the desired angle.

1 Claim, 5 Drawing Sheets

STRUCTURE OF GOLF CLUB HEAD

BACKGROUND OF THE INVENTION

The present invention relates to golf club heads, and relates more particularly to such a golf club head which reinforces the connection between the face panel and the top cover plate thereof and, which has a separate neck tube adapted for fastening to a club shaft at the desired angle.

The game of golf has become more and more popular nowadays. When playing the game of golf, different golf clubs shall be used. A golf club is generally comprised of a club shaft, and a club head fastened to one end of the club shaft. FIG. 1 shows the structure of a golf club head according to the prior art. This structure of golf club head is generally comprised of a head plate 11, a sole plate 12, and a face plate 13 having a neck 131 adapted for coupling to a club shaft. This structure of golf club head has drawbacks. Because the sole plate 12 and the face plate 13 are fastened together by welding, the connection area between the sole plate 12 and the face plate 13 tends to be broken by impact force, causing the face plate 13 to disconnect from the sole plate 12. Because the neck 131 is molded with the face plate 13 in integrity, the angle of inclination of the club shaft cannot be adjusted relative to the sole plate 12. Furthermore, when the head plate 11 is abutted to the top side of the face plate 13, a gap A is left between the head plate 11 and the top edge of the face plate 13 (see FIG. 2), which must be sealed with a soldering paste E. When the face plate 13 hits the ball, vibrating waves will be transmitted from the face plate 13 to the front edge X of the head plate 11, and the front edge X tends to be damaged, or forced to disconnect from the face plate 13.

SUMMARY OF THE INVENTION

The present invention has been accomplished to provide an improved structure of golf club head which eliminates the aforesaid drawbacks. According to one aspect of the present invention, the golf club head is comprised of a bowl-like casing, a top cover plate, and a neck tube, wherein the bowl-like easing has a front side forming a face panel; the top cover plate is welded to the bowl-like casing at the top in a flush manner, having a plurality of rear projections raised from the rear side and supported on the top edge of the bowl-like casing at the back and then fixedly secured thereto by welding, and a plurality of smoothly and downwardly curved front projecting blocks respectively abutted against the back side of the face panel and then fixedly secured thereto by welding. According to another aspect of the present invention, the top cover plate has a side notch; the bowl-like casing has a smoothly curved coupling receptacle defined at one end of the face panel at the back side; the neck tube is inserted through the side notch of the top cover plate into the coupling receptacle of the bowl-like casing, and then fixedly welded thereto at the desired angle.

DETAILED DESCRIPTION OF THE PREFERRED EMBODIMENT

Figure 1:
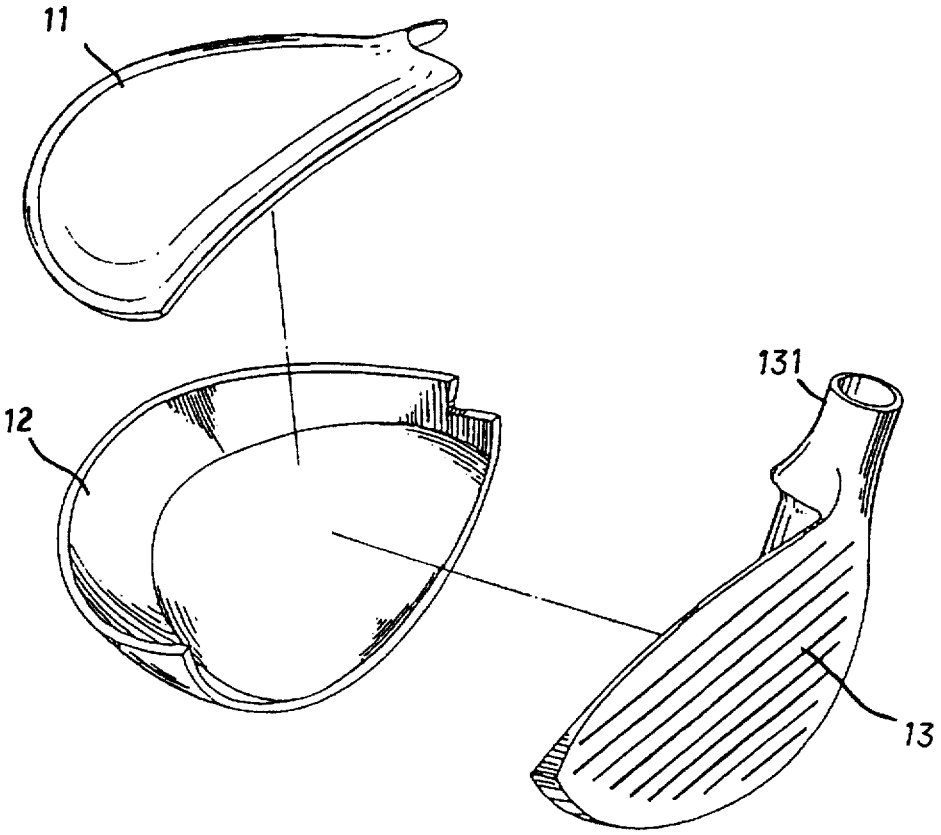
FIG.1 (Prior Art)
FIG. 1 is an exploded view of a golf club head according to the prior art.
Figure 2:
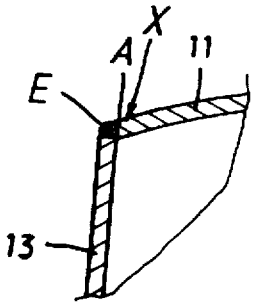
FIG.2 (Prior Art)
FIG. 2 is a sectional view of a part of the golf club head shown in FIG. 1, showing the connection between the head plate and the face plate.
Figure 3:
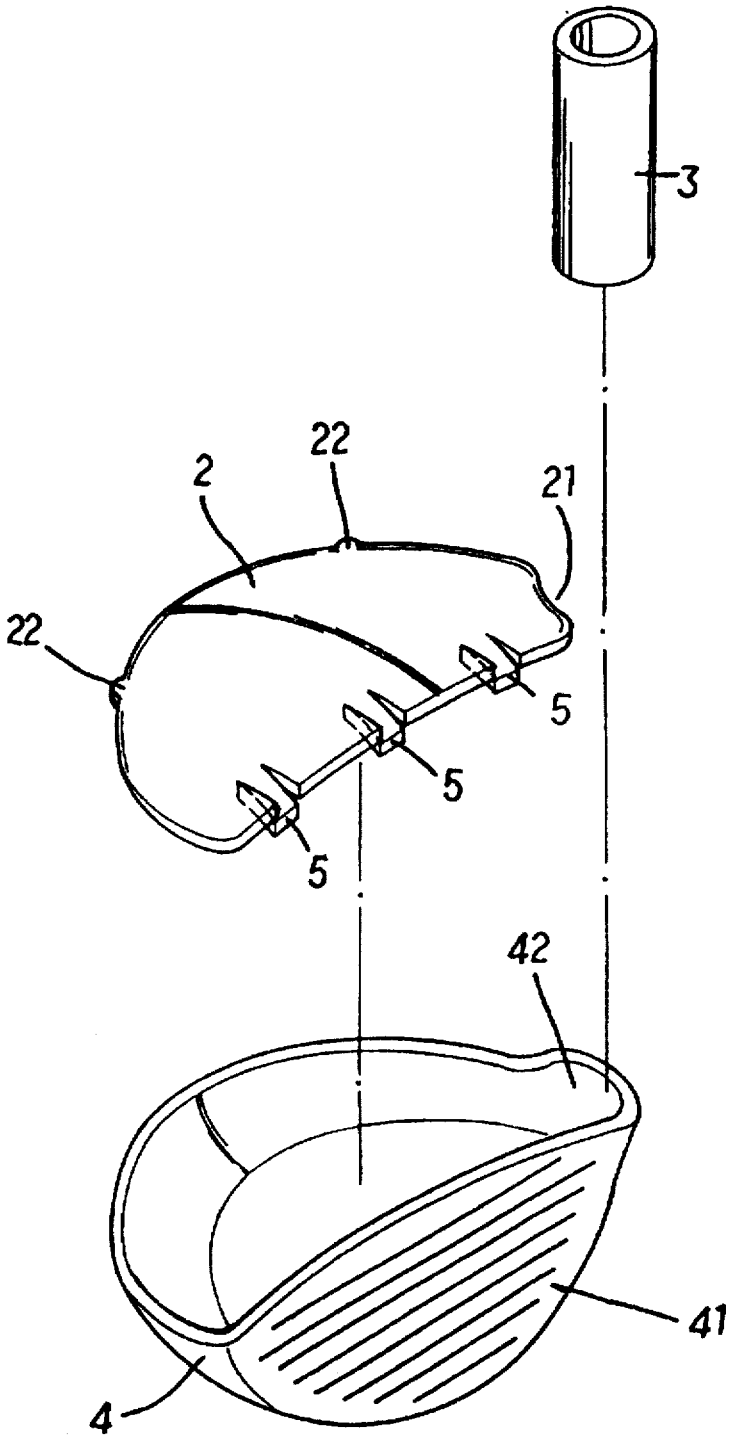
FIG. 3 is an exploded view of a golf club head according to the present invention.
Figure 4:
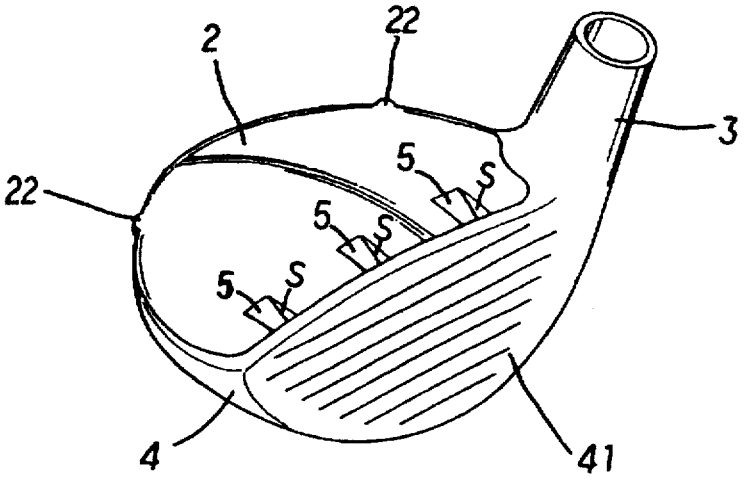
FIG. 4 is an assembly view of the golf club head shown in FIG. 3 (not welded)
Figure 6:
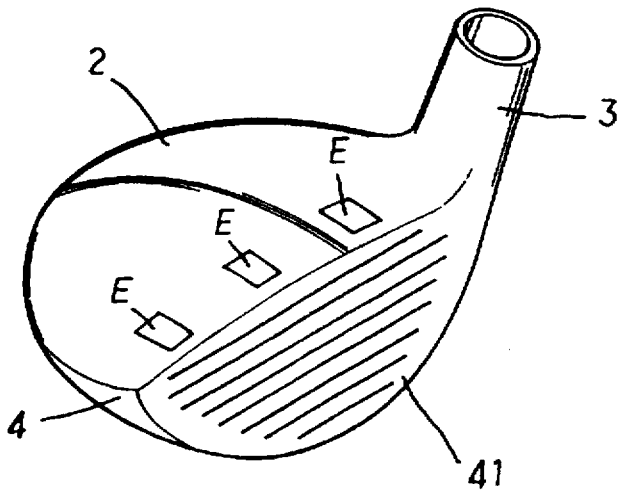
FIG. 6 is an assembly view of the golf club head shown in FIG. 3 (when welded)

Referring to FIGS. 3 and 4, a golf club head in accordance with the present invention is generally comprised of a bowl-like casing 4, a top cover plate 2, and a neck tube 3. The bowl-like casing 4 is integrally forged from metal, having a face panel 41 at the front side, and a smoothly curved coupling receptacle 42 connected to the face panel 41 at one end and adapted for receiving the neck tube 3. The top cover plate 2 is welded to the bowl-like casing 4 at the top, having a notch 21 at one end fitting over the smoothly curved coupling receptacle 42 at the top for receiving the neck tube 2. when the top cover plate 2 is welded to the bowl-like casing 4 at the top, the outside surface of the top cover plate 2 is disposed in flush with the outside surface of the casing 4 (see FIG. 6).

Figure 5:
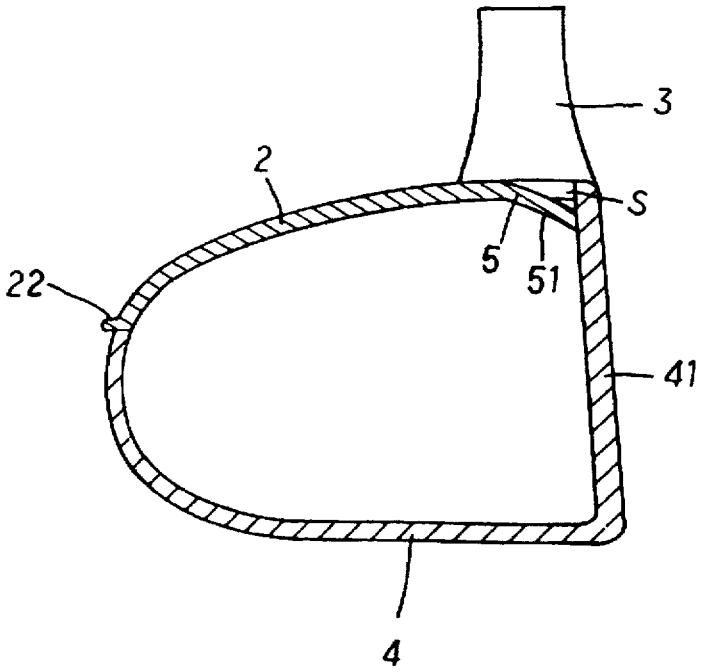
FIG. 5 is a sectional view of FIG. 4.
Figure 7:
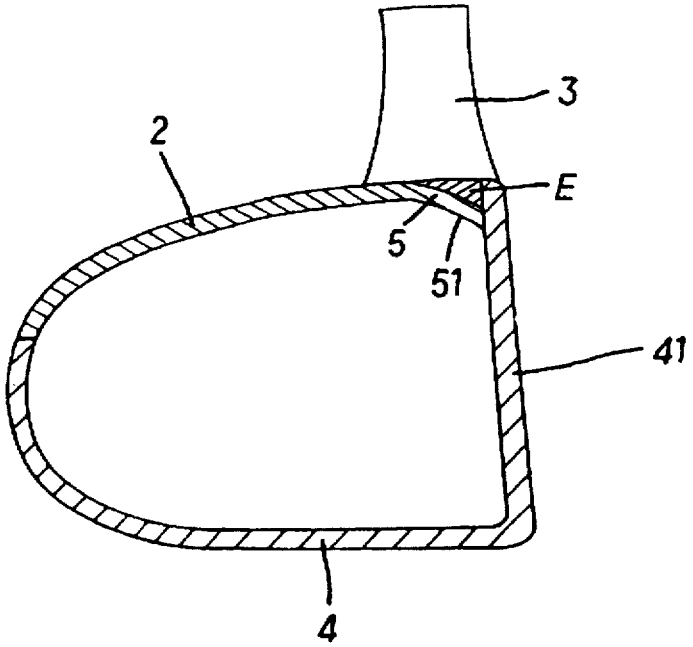
FIG. 7 is a sectional view of FIG. 6.

Referring to FIG.s from 3 to 7, the top cover plate 2 comprises a plurality of front projecting blocks 5 at the front side, and a plurality of rear projections 22 raised from the rear side. Each of the front projecting blocks 5 has a front end 51 curving downwards (see FIGS. 5 and 7). When the top cover plate 2 is covered on the bowl-like casing 4, the rear projections 22 are supported on the periphery of the rear side of the bowl-like casing 4 at the top, the front ends 51 of the front projecting blocks 5 are abutted against the back side of the face panel 41. When the neck tube 3 is inserted through the notch 21 of the top cover plate 2 into the coupling receptacle 42 of the bowl-like casing 4 and set at the desired angle, the top cover plate 2, the neck tube 3, and the bowl-like casing 4 are welded together, and a solder E is sealed to the top cover plate 2 and the bask side of the face panel 41 to seal up the gaps S around the front projecting blocks 5 in a flush manner.

Figure 8:
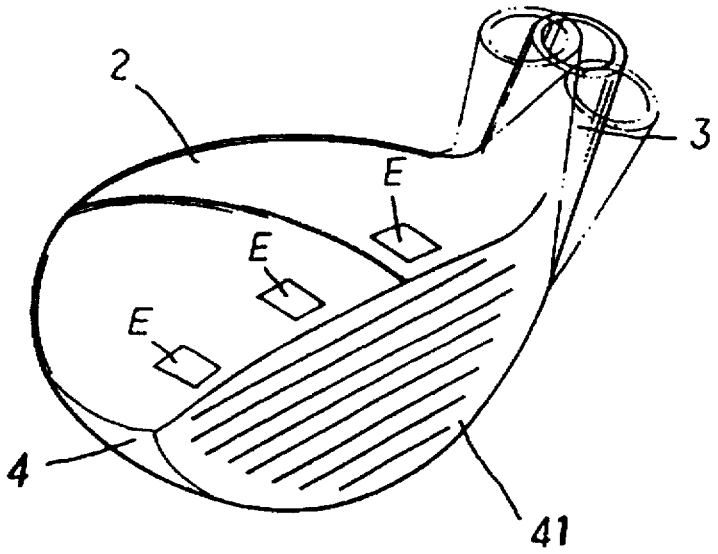
FIG. 8 is a schematic drawing of the present invention, showing different angular positions of the neck tube; and, FIG. 9 is a partial view in section of the present invention, showing the connection between the top cover plate and the face panel.

The top cover plate 2, the neck tube 3, and the bowl-like casing 4 are respectively made from titanium alloy for the advantages of light weight and high structural strength. Because the face panel 41 is integrally made with the bowl-like casing 4 by forging, there is no connecting face between the bowl-like casing 4 and the face panel 41, therefore impact force can be evenly distributed from the face panel 41 through the bowl-like casing 4. As stated, the top cover plate 1, the neck tube 3, and the bowl-like casing 4 are separately made and then welded together, therefore the angular position of the neck tube 3 relative to the face panel 41 can be adjusted as desired before it is welded to the bowl-like casing 4 (see FIG. 8).

Figure 9:
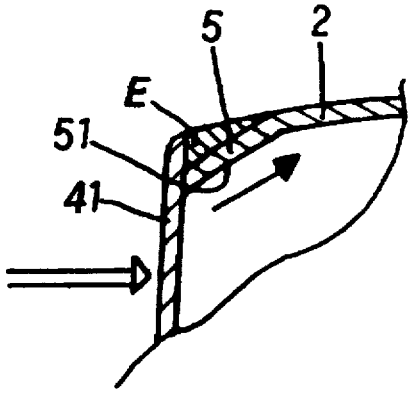

Referring to FIG. 9, because the front ends 51 of the front projecting blocks 5 of the top cover plate 2 are welded to the back side of the face panel 41, impact force can be evenly distributed from the face panel 2 to the top cover plate 2 through the front projecting blocks 5, therefore no stress will be concentrated at the connecting area between the top cover plate 2 and the face panel 41.

It is to be understood that the drawings are designed for purposes of illustration only, and are not intended as a definition of the limits and scope of the invention disclosed.

What the invention claimed is:

1. A golf club head comprising a bowl-like casing integrally made from metal by forging, having a front side forming a face panel, and a smoothly curved coupling receptacle disposed at one end of a back side of said face panel; a top cover plate covered on said bowl-like casing and welded thereto in a flush manner, said top cover plate comprising a plurality of rear projections raised from a rear side thereof and respectively supported on and welded to said bowl-like casing at one side remote from said face panel, a side notch fitting over the coupling receptacle of said bowl-like casing, and a plurality of smoothly and downwardly curved front projecting blocks at a front side thereof respectively welded to the back side of said face panel; and a neck tube inserted through the side notch of said top cover plate into the coupling receptacle of said bowl-like casing and then welded thereto at the desired angle.

* * * * *